US011189950B2

(12) United States Patent
Pape et al.

(10) Patent No.: US 11,189,950 B2
(45) Date of Patent: Nov. 30, 2021

(54) PLUG CONNECTOR WITH A CONDUCTIVE RUBBER ELEMENT

(71) Applicant: HARTING Electronics GmbH, Espelkamp (DE)

(72) Inventors: Günter Pape, Enger (DE); Andreas Kohler, Minden (DE); Andreas Schwarz, Kirchlengern (DE); Torsten Wolf, Espelkamp (DE)

(73) Assignee: HARTING Electronics GmbH, Espelkamp (DE)

( * ) Notice: Subject to any disclaimer, the term of this patent is extended or adjusted under 35 U.S.C. 154(b) by 280 days.

(21) Appl. No.: 16/090,808

(22) PCT Filed: Apr. 3, 2017

(86) PCT No.: PCT/DE2017/100256
§ 371 (c)(1),
(2) Date: Oct. 2, 2018

(87) PCT Pub. No.: WO2017/178007
PCT Pub. Date: Oct. 19, 2017

(65) Prior Publication Data

US 2020/0328549 A1 Oct. 15, 2020

(30) Foreign Application Priority Data

Apr. 12, 2016 (DE) ..... 10 2016 106 704.0

(51) Int. Cl.
*H01R 13/24* (2006.01)
*H01R 4/58* (2006.01)
(Continued)

(52) U.S. Cl.
CPC ..... *H01R 13/2414* (2013.01); *H01R 4/58* (2013.01); *H01R 12/712* (2013.01); *H01R 13/6658* (2013.01)

(58) Field of Classification Search
CPC .... H01R 13/2414; H01R 13/665; H01R 4/58; H01R 12/714; H01R 13/5219;
(Continued)

(56) References Cited

U.S. PATENT DOCUMENTS 4,519,659 A 5/1985 Shiino et al.
4,859,194 A * 8/1989 Bartholomew ..... H01R 24/20 439/125
(Continued)

FOREIGN PATENT DOCUMENTS

AU 753112 B2 10/2002
CN 201515022 U 6/2010
(Continued)

OTHER PUBLICATIONS

English Translation of JPH0869830A (Year: 1996).*
(Continued)

*Primary Examiner* — Edwin A. Leon
*Assistant Examiner* — Matthew T Dzierzynski
(74) *Attorney, Agent, or Firm* — Seed IP Law Group LLP

(57) ABSTRACT

A plug connector to which a cable having at least one insulated conductor can be connected is provided, wherein the plug connector has a conductive rubber element with at least one conductive layer, but preferably with at least two conductive layers. The electrical connection of the conductors is realized by the conductive rubber element. The conductive rubber element can also form the plug face of the plug connector. As an alternative, the conductors can be connected to contact elements by the conductive rubber element.

13 Claims, 6 Drawing Sheets

(51) Int. Cl.
*H01R 12/71* (2011.01)
*H01R 13/66* (2006.01)

(58) Field of Classification Search
CPC .... H01R 12/77; H01R 12/78; H01R 2201/12; H01R 2201/26; H01R 24/20; H01R 43/007; H01R 12/59; H01R 12/592; H01R 12/62; H01R 12/7011; H01R 12/716; H01R 12/774; H01R 12/79; H01R 13/52; H01R 13/521
See application file for complete search history.

(56) References Cited

U.S. PATENT DOCUMENTS

| | | | | |
|---|---|---|---|---|
| 5,007,843 | A * | 4/1991 | Smolley | G01R 1/07307 257/E23.172 |
| 5,720,630 | A * | 2/1998 | Richmond | H01R 13/2414 439/591 |
| 5,738,546 | A * | 4/1998 | Burroughs | H01R 24/44 333/25 |
| 5,782,645 | A | 7/1998 | Stobie et al. | |
| 6,210,239 | B1 | 4/2001 | Harting et al. | |
| 6,403,226 | B1 * | 6/2002 | Biernath | H01R 13/2414 428/209 |
| 6,575,764 | B1 * | 6/2003 | Reipur | H01R 13/24 439/289 |
| 7,223,105 | B2 * | 5/2007 | Weiss | H01R 13/2414 439/497 |
| 7,355,122 | B2 * | 4/2008 | Moore | E21B 33/0385 174/84 R |
| 8,529,277 | B2 * | 9/2013 | Williams | H01R 12/77 439/75 |
| 9,004,928 | B2 * | 4/2015 | Tanaka | B60L 3/0069 439/86 |
| 9,511,216 | B2 * | 12/2016 | Suwito | A61N 1/372 |
| 9,601,842 | B2 * | 3/2017 | Lee | H01R 4/4809 |
| 9,966,684 | B2 * | 5/2018 | Ko | H01R 13/5219 |
| 10,149,980 | B2 * | 12/2018 | Shah | A61N 1/3752 |
| 10,411,385 | B2 * | 9/2019 | Higashitani | H01R 13/2414 |
| 2004/0248461 | A1 | 12/2004 | Marcinkiewicz et al. | |
| 2007/0227757 | A1 | 10/2007 | Moore | |
| 2012/0315772 | A1 | 12/2012 | Joschika | |
| 2013/0040473 | A1 * | 2/2013 | Tanaka | H01R 24/68 439/86 |
| 2017/0229793 | A1 | 8/2017 | Schmidt et al. | |

FOREIGN PATENT DOCUMENTS

| | | | | |
|---|---|---|---|---|
| CN | 102176569 | A | 9/2011 | |
| CN | 102709768 | A | 10/2012 | |
| CN | 202550078 | U | 11/2012 | |
| CN | 103887616 | A | 6/2014 | |
| DE | 25 20 590 | C2 | 2/1983 | |
| DE | 42 09 097 | A1 | 9/1993 | |
| DE | 196 04 432 | A1 | 8/1997 | |
| EP | 0 935 310 | A2 | 8/1999 | |
| EP | 2 040 343 | A1 | 3/2009 | |
| EP | 2 417 675 | B1 | 5/2014 | |
| GB | 1 505 678 | A | 3/1978 | |
| JP | H0869830 | A * | 3/1996 | H05K 3/325 |
| WO | 00/21160 | A1 | 4/2000 | |
| WO | 2011/103874 | | 9/2011 | |
| WO | 2016/034166 | A2 | 3/2016 | |

OTHER PUBLICATIONS

European Search Report for EP application No. 17720665.3 dated Nov. 11, 2019, 5 pages.
German Office Action, dated Feb. 20, 2017, for German Application No. 10 2016 106 704.0, 8 pages.
International Search Report and Written Opinion, dated Jul. 13, 2017, for International Application No. PCT/DE2017/100256, 12 pages. (with English Translation of Search Report).
Chinese Office Action, dated May 27, 2019, for Chinese Application No. 201780022704.0, 7 pages.
Chinese Office Action for patent application No. 201780022704.0, dated Apr. 2, 2020, 8 pages.
International Preliminary Report on Patentability, dated Oct. 16, 2018, for International Application No. PCT/DE2017/100256, 6 pages.

* cited by examiner

PLUG CONNECTOR WITH A CONDUCTIVE RUBBER ELEMENT

BACKGROUND

Technical Field

This disclosure relates to a plug-in connector to which a cable having at least one insulated conductor is connectable, and furthermore to a system comprising a plug-in block and circuit board plug-in connector. Plug-in connectors of the aforementioned type are used for transmitting data signals but also for transmitting currents. It is quite possible using plug connectors of the aforementioned type to transmit currents of one ampere or multiple amperes.

Description of the Related ArtEP 2 417 675 B1 discloses a multi-pole plug-in connector whose connected cable comprises multiple individual conductors that are in electrical contact with the plug-in connector via insulation-displacement clamps. Generally, only so-called stranded wires are connected using insulation-displacement clamps. The electrical contact with so-called solid conductors may be less reliable using the insulation-displacement clamp technology. Since the insulation-displacement clamps require a comparatively large installation space in order to be able to reliably contact the conductors, an even smaller construction of plug-in connectors of this type may only be achieved with great difficulty. Moreover, the number of conductor cross-sections that may be connected is limited. It is often not possible to detach and re-connect an insulation-displacement clamp connection as desired.

EP 935 310 A2 discloses plug connectors having screw connections for the individual conductors of multicore cables. A tool is required in this case for the assembly procedure. The screw connection technology requires a comparatively large installation space and may therefore only be used in a limited range of applications.

It is sufficiently known from WO 2016/034166 A2 to connect the contact elements of plug-in connectors to the conductors of a cable using crimping technology. However, a crimp connection is not detachable and consequently the connection may only be made once. Moreover, the crimping procedure requires complex tools.

Electrical components such as those illustrated in WO 00/021160 A1 that use a so-called cage clamp spring to connect conductors require a tool, by way of example a screw driver, to connect or disconnect the conductors. As an alternative to the tool, it is also possible to provide a separate actuator on the component. The cage clamp springs also require a large amount of space in the component.

The aforementioned connection technologies all have the disadvantage that they are unsuitable for use in the case of plug-in connectors that are required to process very high data rates.

BRIEF SUMMARY

Embodiments of the invention provide a plug-in connector that is able to transport data signals and currents in a reliable manner. Simultaneously, the plug-in connector is designed to be simple to assemble and small in size.

The disclosure relates to a plug-in connector to which is connected a cable having at least one electrical conductor that is located in said cable. A so-called multicore cable is used in many applications. At least two electrical conductors that are insulated with respect to one another are located in a multicore cable. The insulation is typically provided via a dedicated synthetic material sheath of the conductors.

Different embodiments of the invention are described below using an example of a cable having at least two conductors. However, the invention is not explicitly limited to multicore cables and always also relates to a single core cable.

A cable having at least two individual conductors that are insulated with respect to one another may be connected to the plug-in connector, wherein the plug-in connector comprises a conductive rubber element having at least one conductive layer but preferably at least two conductive layers. The plug-in connector comprises a conductive rubber element having individual conductive layers in order to use the connection technology for individual conductors. This connection technology produces a particularly small construction and is simultaneously suitable for a multiplicity of conductor cross-sections.

According to embodiments of the invention, the conductive rubber element comprises an elastically deformable material having alternating conductive and non-conductive layers. Conductive particles are incorporated in the conductive layers. However, a conductive polymer itself may also form such a conductive layer. A non-conductive layer is generally provided around the edge layers of the conductive rubber element.

In order to produce the electrical contact, a conductor is brought into contact with at least one conductive layer of the conductive rubber element. However, it is also possible that a conductor is in contact with at least two or more such conductive layers simultaneously. This state is dependent upon the so-called conductor diameter and upon the so-called grid dimension of the conductive rubber element.

Embodiments of the invention further relate to a system comprising a plug-in block and a circuit board plug-in connector, wherein at least two solid or stranded conductors are fixed within the plug-in block arranged parallel with one another and with their respective conductor end aligned with a direction vector parallel and/or orthogonal to the plug-in direction. A conductive rubber element is also arranged in this case either in the plug-in block or in the circuit board plug-in connector, said conductive rubber element being used as the connection technology for the individual conductors of the cable or to make contact with the conductor tracks in the circuit board.

Variants of embodiments of the invention are further described below. As already mentioned above, variants having single core or multicore connected cables are discussed equally.

A cable having at least two individual, insulated conductors may be connected to the plug-in connector in accordance with embodiments of the invention. A multicore cable is also discussed here. The plug-in connector comprises a conductive rubber element having at least two conductive layers. DE 25 20 590 C2 discloses conductive rubber elements of this type. Conductive rubber elements are embodied from an elastomer material that comprises alternating conductive and non-conductive layers. Generally, conductive materials, such as by way of example gold and/or silver and/or carbon particles, are incorporated in the conductive layers. A conductive rubber element may also be produced in that the afore-mentioned materials are embedded in a silicon material.

Generally, a person skilled in the art assumes that the conductivity is good as soon as the material gold is used. A conductive rubber element was tested that comprised gold-coated copper wires. If the conductive rubber element is compressed to a great extent, these gold-coated copper wires have a tendency to break, as a result of which the level of conductivity is reduced. It has been established in this respect that the conductive rubber element, which comprises the above-mentioned gold material, in the case of plug connectors, in particular in the case of plug-in connectors that are provided for transmitting higher data rates, perform less well than a conductive rubber element that comprises a silver material, preferably silver particles. Therefore, it is particularly preferred to use a conductive rubber element that comprises a silver material. Such a conductive rubber element has demonstrated particularly in the high frequency range very good insulating properties and through-flow resistances. The material in the plug-in connector also demonstrates good current carrying capacity values even under hard climatic conditions.

The conductive function of the individual conductive layers of the conductive rubber element is rendered possible by virtue of the fact that the individual layers are compressed or pressed together. As a consequence, the homogenously distributed conductive particles are brought into contact and consequently form a closed conductive section within the conductive layer.

A multicore cable having multiple individual conductors is generally connected to the plug-in connector. Embodiments of the invention are described using an example of at least two conductors. However, the cable may comprise any number of such conductors. The number of connection contacts, the conductive layers of the conductive rubber element and the contact elements then increases accordingly.

In one variant of a plug-in connector, the individual conductors may be fixed in an electrically conductive manner respectively to a conductive layer of the conductive rubber element. One conductor is connected in an electrically conductive manner to a first conductive layer of the conductive rubber element, whereas a further conductor is connected in an electrically conductive manner to another conductive layer of the conductive rubber element. The individual conductors of the connected cable are electrically connected to the individual conductive layers of the conductive rubber element. The electrical signals or currents may be transmitted directly to contact elements of the plug-in connector via the conductive layers of the conductive rubber element. However, it is also possible to select other possibilities as further explained below.

It is also possible that an individual conductor may be fixed in a conductive manner simultaneously to multiple conductive layers of the conductive rubber element. A further conductor may then be connected to multiple other conductive layers of the conductive rubber element. If multiple conductive layers for contacting an individual conductor, connection contact or contact element are involved, this is also described as layer groups.

If an individual conductor is connected in an electrical manner simultaneously to multiple conductive layers of the conductive rubber element, in other words to form a layer group, it is necessary to connect a corresponding partner, by way of example a contact element, to the same layer group in an electrical manner. It is possible in this case that, on account of an imperfect positioning of the conductor and/or contact element, not all conductive layers contribute to the electrical contact between the conductor and the contact element. It is important that the conductor or the contact element does not have a conductive layer common with an adjacent conductor or contact element. The spacing between the conductors and the contact elements must be selected accordingly in dependence upon the grid dimension of the conductive rubber element. The conductors and the contact elements must correspond with one another.

The grid dimension of the conductive rubber element is generally at least a factor of 20 smaller than the spacing between the conductors and the contact elements. As a consequence, it is not necessary for the assembly process to be absolutely precise.

In one advantageous embodiment, the plug-in connector comprises at least one connection contact. Advantageously, the plug-in connector comprises at least two connection contacts that may be fixed in an electrically conductive manner respectively to one conductive layer or to multiple conductive layers of the conductive rubber element. The connection contacts may be electrically contacted respectively by a conductor end of a conductor. In this embodiment, the individual conductors of the multicore cable are not directly connected to the individual conductive layers or the conductive layer groups of the conductive rubber element but rather are connected thereto via the so-called connection contacts.

It is advantageous if technology that uses contact pressure is used to provide such an electrical contact or such an arrangement of fixing the conductor and conductive rubber element. The conductor end that is stripped of insulation is pressed onto the conductive layer or onto the conductive layers via suitable means or devices. Contact-pressure means or devices of this type may be implemented in different ways. Variants of contact-pressure means or devices in accordance with embodiments of the invention are proposed below.

Advantageously, the plug-in connector comprises at least one contact element but preferably at least two contact elements. The conductors may be contacted respectively by a connection contact. The connection contacts are in turn in electrical contact on one face of the conductive rubber element respectively with one conductive layer or with multiple conductive layers and on the other face of the conductive rubber element the contact elements are in contact respectively with one corresponding conductive layer or with corresponding conductive layers of the conductive rubber element. The electrical signals or currents are transmitted from the conductor via the connection contact, then via the conductive layer or the conductive layers of the conductive rubber element finally to the contact element. In the case of a construction of this type, the individual conductors may be connected in a detachable manner to the plug-in connector, in contrast to connections formed using insulation-displacement clamp technology and crimping technology. The procedure of pressing the conductor ends against the conductive rubber element may be performed in an absolutely destruction-free and detachable manner. Furthermore, an additional tool is not required for assembling such a plug-in connector, which is otherwise the case for a crimp or screw connection. An additional advantage resides in the fact that it is possible to connect the most varied conductor cross-sections. Furthermore, solid and stranded conductors may be used equally.

In a particularly advantageous embodiment, the individual conductors may also be directly connected in an electrically conductive manner to the associated contact elements via the conductive rubber element. On one face of the conductive rubber element, the conductors may be fixed in an electrically conductive manner respectively to one conductive layer or to multiple conductive layers of the conductive rubber element and on the other face of the conductive rubber element the contact elements are in contact respectively with one corresponding conductive layer or with multiple corresponding conductive layers. A construction of this type may be implemented in a particularly space-saving manner.

A system comprising a plug-in block and a circuit board plug-in connector is also proposed within the scope of the invention. At least one solid or stranded conductor is fixed in the plug-in block, in particular preferably however at least two solid or stranded conductors arranged parallel with one another and with their respective conductor end aligned with a direction vector parallel and/or orthogonal with respect to the plug-in direction.

Advantageously, the plug-in block comprises a conductive rubber element, wherein the conductor ends are in contact with respectively one conductive layer or with multiple conductive layers of the conductive rubber element. Alternatively, the circuit board plug-in connector comprises a conductive rubber element, wherein in the plug-in direction respectively one conductive layer or multiple conductive layers of the conductive rubber element is/are aligned with the different conductor ends of the solid conductor or stranded conductor. In the first case, the conductive rubber element is used on the one hand as a connection possibility for the individual conductors. On the other hand, the conductive layers of the conductive rubber element form the so-called plug-in face of the plug-in block. The plug-in block then assumes the function of a plug-in connector.

In some advantageous embodiments the circuit board plug-in connector comprises at least two contact elements having respectively a contact end and a circuit board connection end, wherein the respective contact ends are in contact with a conductive layer or with multiple conductive layers of the conductive rubber element. The circuit board connection ends are by way of example soldered to a circuit board and as a consequence are connected in an electric manner to associated conductor tracks.

BRIEF DESCRIPTION OF THE SEVERAL VIEWS OF THE DRAWINGS

Exemplary embodiments of the invention are illustrated in the drawings and are further explained below. In the drawings.

The figures show in parts simplified, schematic views. In part, identical reference numerals are used for similar but possibly not identical elements. Different views of similar elements may be scaled differently.

Figure 1:
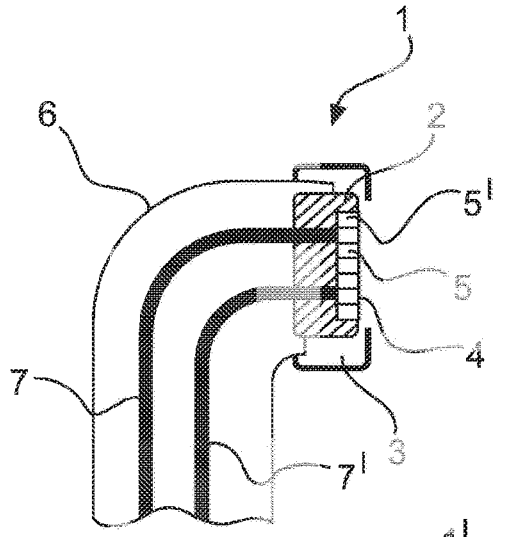
FIG. 1 illustrates a schematic sketch of a plug-in connector.

For representational reasons in the figures, one conductor, one connection contact and one contact element is always connected to only one conductive layer 5, 5' of the conductive rubber element 4. In practice, however, multiple conductive layers 5, 5' may be connected simultaneously to one of the above-mentioned elements. A procedure of this type has the advantage that it is not necessary to assemble such a plug-in connector 1 so precisely. If by way of example five conductive layers 5, 5' are contacted by one conductor 7, 7', the associated contact element 8, 8' is however arranged in a slightly offset manner but it still has three conductive layers 5, 5' in common with the conductor 7, 7' so that a conductive connection is still guaranteed between the conductor 7, 7' and the contact element 8, 8' via the conductive rubber element 4. As a consequence, such a plug-in connector may be assembled in the field in a particularly simple manner.

DETAILED DESCRIPTION

FIG. 1 illustrates a plug-in connector 1 that comprises an insulating body 2 and a plug-in connector housing 3 that is arranged around said insulating body. A conductive rubber element 4 is arranged within the insulating body 2. The conductive rubber element 4 comprises a plurality of conductive layers 5, 5' that are arranged adjacent to one another. The conductive layers are separated in each case by a non-conductive layer.

A multicore cable 6 is connected to the plug-in connector 1. The cable 6 in this exemplary embodiment comprises two insulated conductors 7, 7'. The ends of the conductors 7, 7' are stripped of insulation and connected respectively to one conductive layer 5, 5' of the conductive rubber element 4.

The electric connection of the conductors 7, 7' of the cable 6 is provided on the rear face of the conductive rubber element 4. The opposite-lying front face of the conductive rubber element 4 is oriented in the plug-in direction. The individual conductive layers 5, 5' of the conductive rubber element 4 form the electrical contact or connection sites of the plug-in connector 1 and assume the function of contact elements.

Figure 2:
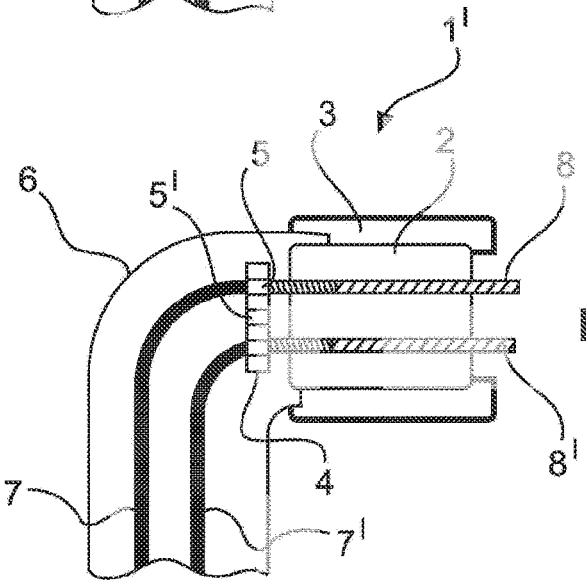
FIG. 2 illustrates a schematic sketch of a further plug-in connector.

FIG. 2 illustrates an alternative embodiment of a plug-in connector 1' in accordance with the invention. The individual conductors 7, 7' of the connected cable 6 are connected in an electrical manner to the associated conductive layers 5, 5' on the rear face of the conductive rubber element 4. Contact elements 8, 8' are connected on the front face to the individual layers 5, 5'. The contact elements 8, 8' in this embodiment form the plug-in face of the plug-in connector 1'.

Figure 3:
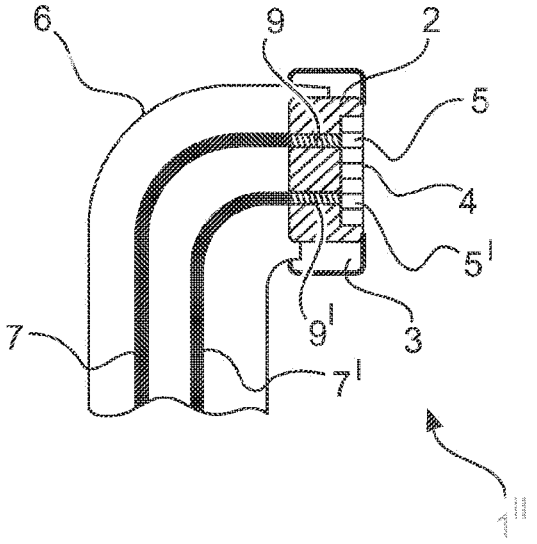
FIG. 3 illustrates a schematic sketch of a further plug-in connector.

FIG. 3 illustrates a further alternative embodiment of a plug-in connector 1" in accordance with the invention. The individual conductors 7, 7' of the connected cable 6 are connected in this version respectively to a so-called connection contact 9, 9'. The electrical connection may be performed in this case by way of example via the tried and tested crimp technology or via another suitable connection technology.

The connection contacts 9, 9' are in electrical contact with and connected respectively to a conductive layer 5, 5' of the conductive rubber element 4 on the rear face of the conductive rubber element 4. The front face of the conductive rubber element 4 forms the plug-in face of the plug-in connector 1". The connection contacts 9, 9' may also be provided in the case of the plug-in connector 1' in accordance with FIG. 2.

The above-mentioned connection contacts 9, 9' differ from the contact elements 8, 8' amongst other things by virtue of the fact that the contact tips, in other words the region that is in contact with the conductive layers 5, 5' of the conductive rubber element 4 may also be configured in a geometrically obtuse manner. Such a geometric shape may be produced in a very simple and cost-effective manner.

Figure 4A:
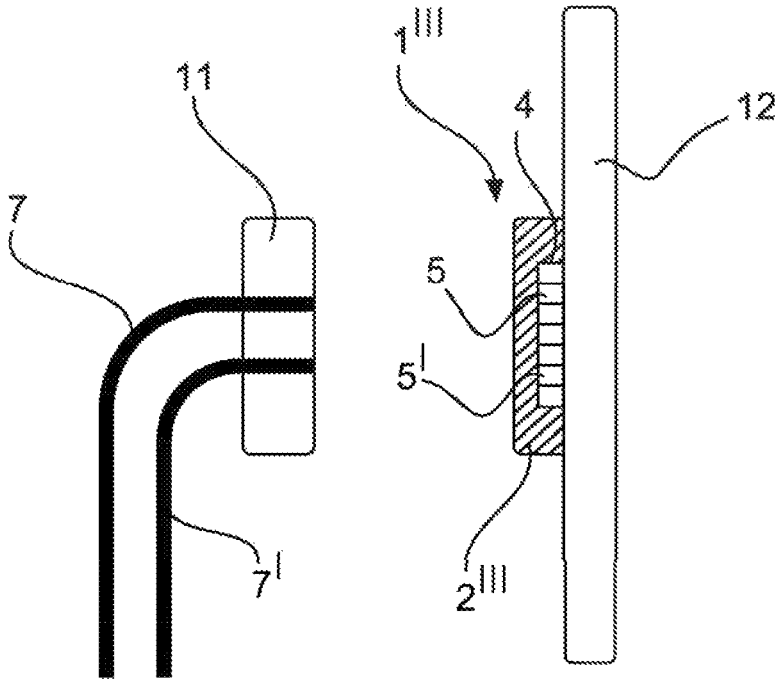
FIG. 4*a* illustrates a schematic sketch of a system comprising a plug-in block and a circuit board plug-in connector.
Figure 5:
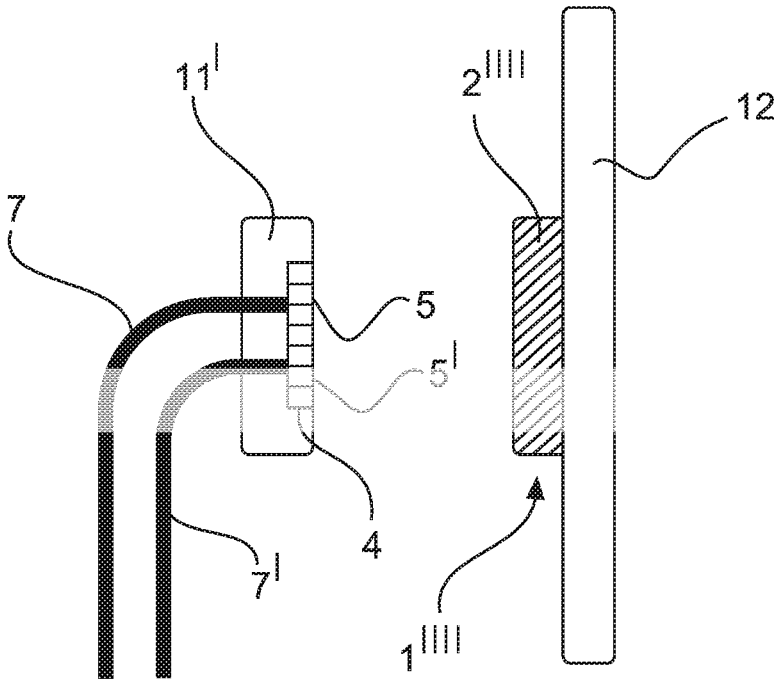
FIG. 5 illustrates a schematic sketch of an alternative system comprising a plug-in block and a circuit board plug-in connector.

FIGS. 4*a* and 5 each illustrate a system comprising a plug-in block 11 and a circuit board plug-in connector 12.

FIG. 4*a* illustrates a plug-in block 11 in which conductors 7, 7', solid or stranded conductors as desired, are arranged and fixed with a direction vector orthogonal and/or parallel with the plug-in direction. A circuit board plug-in connector 1'" is illustrated lying opposite, a conductive rubber element 4 being arranged and fixed in the plug-in direction in the insulating body 2'" of said circuit board plug-in connector 1'". The circuit board plug-in connector 1'" is arranged in this case on a circuit board 12. On the rear face, the individual conductive layers 5, 5' of the conductive rubber element 4 are connected in an electrical manner to the conductor tracks (not illustrated) of the circuit board 12. As the plug-in block 11 and the circuit board plug-in connector 1'" are plugged together, the conductor ends of the conductors 7, 7' make contact respectively with an allocated conductive layer 5, 5' of the conductive rubber element 4. As a consequence, the conductors 7, 7' are in electrical contact with the conductor tracks (not illustrated) of the circuit board 12 via the rubber element 4.

Figure 4B:
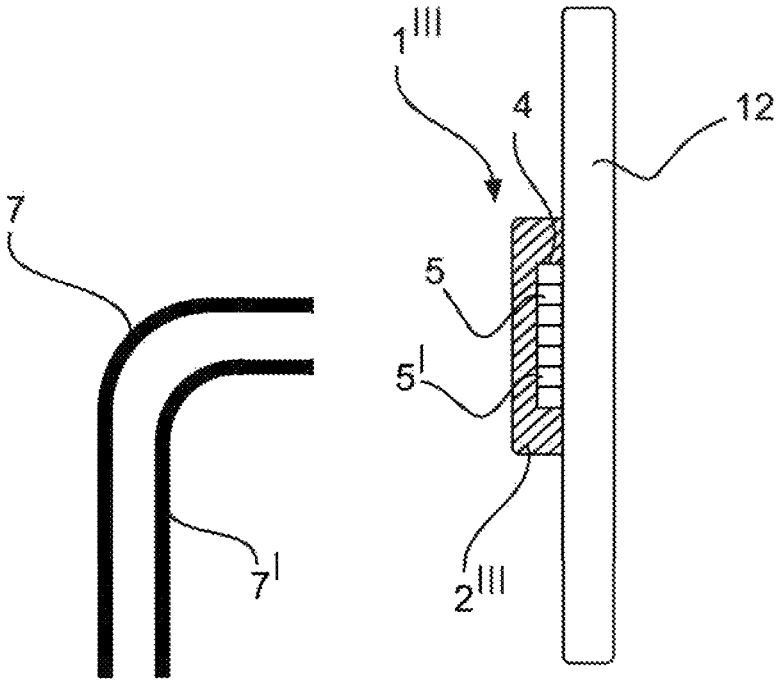
FIG. 4*b* illustrates a schematic sketch of two conductors that may be connected to a circuit board plug-in connector having a conductive rubber element.

FIG. 4*b* illustrates a circuit board plug-in connector 1'" to which it is possible to connect two conductors 7, 7' without a plug-in block (e.g., without plug-in block 11 of FIG. 4*a*). The conductors 7, 7' may be connected by simple contact-pressure means or devices (not illustrated) to the circuit board plug-in connector 1'". In this case, an additional tool is not necessary. The circuit board plug-in connector 1'" comprises a conductive rubber element 4 for connecting the conductors 7, 7'. Such a conductive rubber element requires less installation space than comparable circuit board plug-in connectors that use a so-called cage clamp spring as the connection technology.

FIG. 5 illustrates an alternative embodiment of a system comprising a plug-in block 11' and a circuit board plug-in connector 1"". In this case, the conductive rubber element 4 is arranged in the plug-in block 11'. The conductive ends of the connected conductor 7, 7' are in electrically conductive contact respectively on the rear face of the conductive rubber element 4 with a conductive layer 5, 5'. The conductors 7, 7' are furthermore fixed in the plug-in block 11' in parallel with the plug-in direction. The front face of the conductive rubber element 4 forms the plug-in face of the plug-in block 11'. Contact elements (not illustrated) are arranged in the opposite-lying circuit board plug-in connector 1"". As the plug-in block 11' and the circuit board plug-in connector 1"" are plugged together, the conductive layers 5, 5' of the conductive rubber element are in electrical contact with the allocated contact elements (not illustrated) of the circuit board plug-in connector 1"". As a consequence, the conductors 7, 7' are in electrical contact with the conductor tracks (not illustrated) of the circuit board 12 via the conductive rubber element 4.

Figure 6:
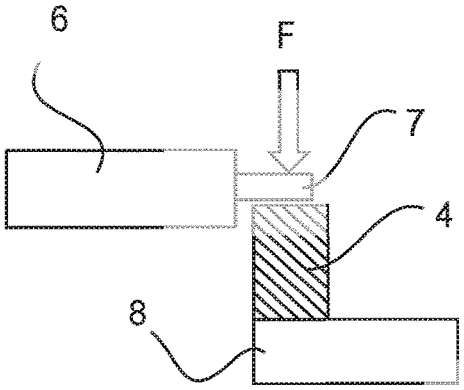
FIG. 6 illustrates a schematic sketch showing one technology for connecting a conductor to a conductive rubber element.
Figure 7:
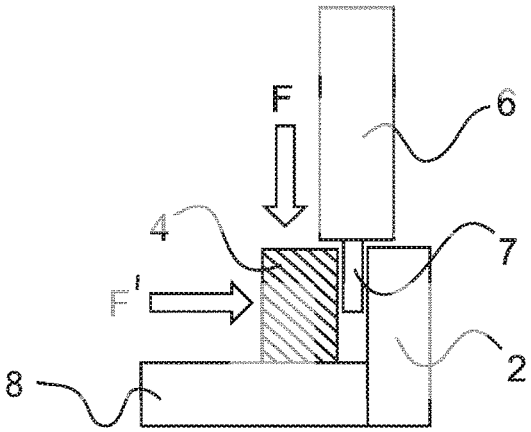
FIG. 7 illustrates a further schematic sketch showing one technology for connecting a conductor to a conductive rubber element.
Figure 8:
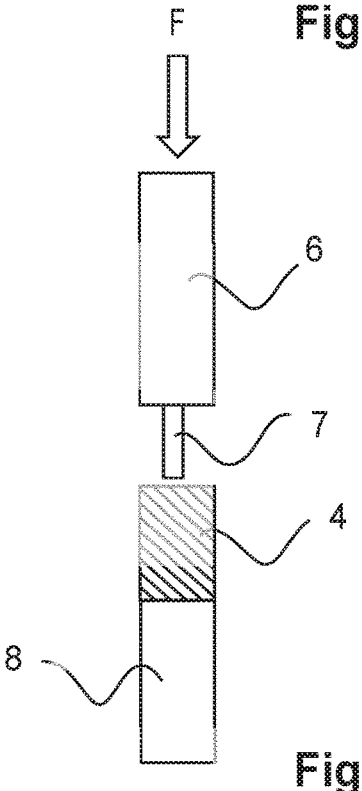
FIG. 8 illustrates a further schematic sketch of one technology for connecting a conductive to a conductive rubber element.

FIGS. 6 to 8 illustrate possible contact-pressure technologies for connecting conductors 7 to a conductive rubber element 4.

FIG. 6 illustrates a section through a plug-in connector 1 in accordance with embodiments of the invention, wherein the plug-in connector housing and the insulating body are not illustrated for representational reasons. A conductor 7 lies in a transverse manner on the conductive rubber element 4. As already described above, generally multiple conductive layers of the conductive rubber element 4 are contacted by the conductor 7. The conductor 7 is pressed against the conductive rubber element 4 by virtue of exerting a force in the direction of the arrow F. The influence of the force also causes the conductive rubber element 4 or its conductive layers to be compressed, as a result of which a conductive structure is produced within the conductive layers. The contact-pressure force produces the electrically conductive connection between the conductor 7 and the contact element 8.

In FIG. 7, the conductor 7 is located between a wall of the insulating body 2 and the conductive rubber element 4. In this example, it is possible as desired to exert a force on the conductive rubber element 4 in the direction of the arrow F (from above) or in the direction of the arrow F' (from the left). If the force acts in the direction of the arrow F, the force is limited in the direction of the arrow F' and conversely. In both cases, the conductive layers of the conductive rubber element 4 are compressed in such a manner that a conductive connection is produced between the conductor 7 and the contact element 8. Alternatively, simultaneously, a force may also act on the conductive rubber element in the direction F and a further force may act in the direction F'.

In FIG. 8, the conductor 7 is pressed in a perpendicular manner against the conductive rubber element and its conductive layers via a force in the direction of the arrow F. As a consequence, a conductive connection is produced between the conductor 7 and the contact element 8. The exemplary embodiment in accordance with FIG. 8 is preferably provided for solid conductors whose conductor ends may penetrate possibly also easily into the conductive rubber element 4 as a result of the effect of the force. FIG. 8 illustrates the conductor 7 where insulation has been stripped. However, it is not absolutely necessary to strip the insulation in order to produce an electrical contact between the conductor 7 and the conductive rubber element 4. The front end of the conductor 7 that has not had the insulation stripped (non-stripped) may be simply pressed onto the conductive rubber element 4.

Figure 9:
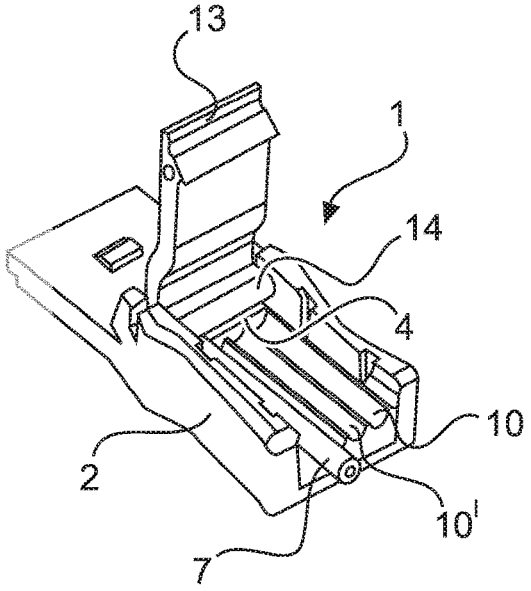
FIG. 9 illustrates a perspective view of an example embodiment of a plug-in connector.
Figure 10:
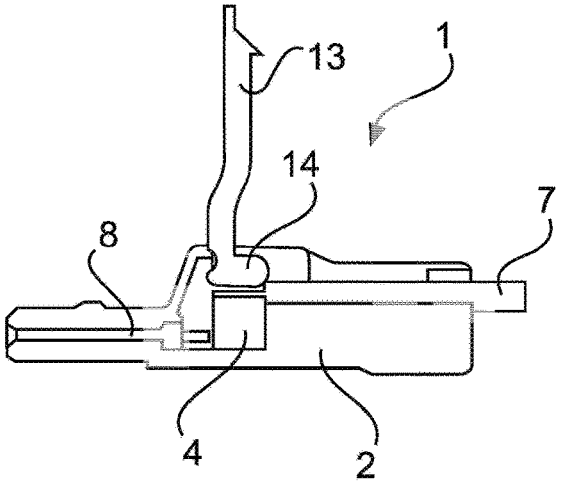
FIG. 10 illustrates a cross-sectional side view of the example embodiment of the plug-in connector shown in FIG. 9.

FIGS. 9 and 10 illustrate a specific exemplary embodiment of a plug-connector 1 in accordance with the invention. The plug-in connector 1 comprises an essentially cuboid insulating body 2. Conductor receiving devices 10, 10' for receiving individual conductors 7 are integrated in the insulating body 2 lying parallel with one another. The conductors 7 of the connected cable 6 (not illustrated) are arranged in the conductor receiving devices 10, 10'.

A locking element 13 is attached in a pivotable manner to the insulating body 2. The locking element 13 in this exemplary embodiment also assumes the function of a flap that closes the plug-in connector 1. The rotatably fixed end of the locking element 13 comprises an elliptical end 14. The stripped end of the conduct 7 is arranged between the conductive rubber element 4 and the elliptical end 14 of the locking element 13. In the illustrated open state, the longitudinal side of the elliptical end 14 is oriented in parallel with the conductor 7 or its conductor end. In the closed state, the elliptical end 14 exerts a force that is directed in a perpendicular manner with respect to the orientation of the conductor 7—similar to the schematic sketch in FIG. 6—onto the conductor end. As a consequence, the conductor end 7 is urged onto one or multiple conductor layers (not illustrated) of the conductive rubber element 4. A conductive connection is produced between the conductor 7 or the conductor end and the contact element 8.

Figure 11:
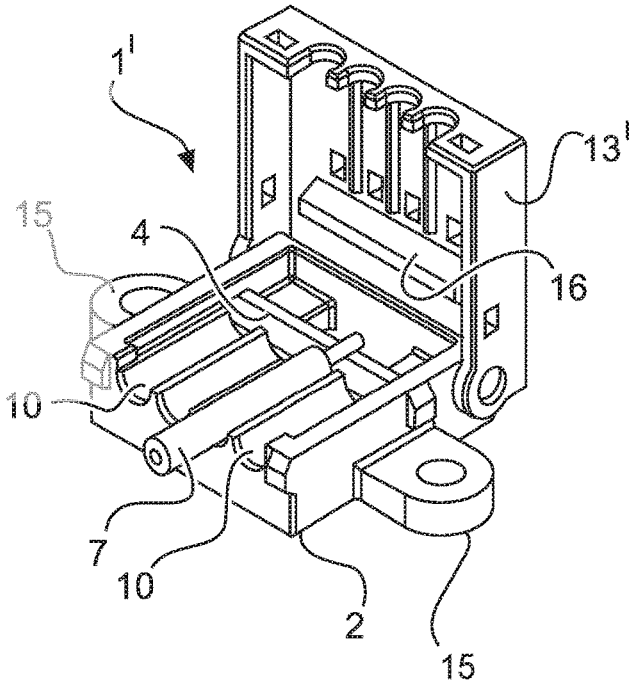
FIG. 11 illustrates a perspective view of another example embodiment of a plug-in connector.
Figure 12:
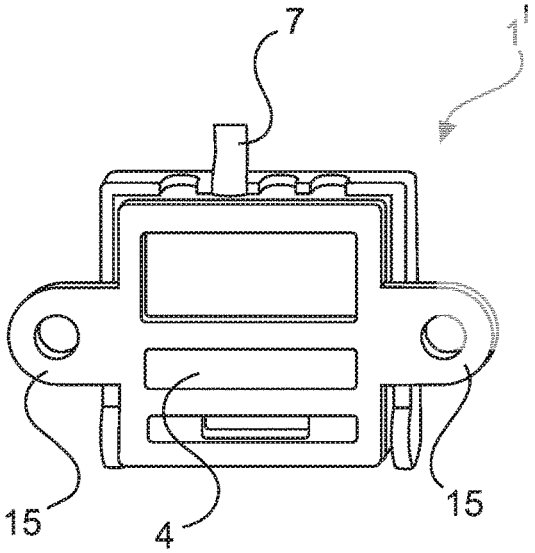
FIG. 12 illustrates a further perspective view of the example embodiment of the plug-in connector shown in FIG. 11.

FIGS. 11 and 12 illustrate a further alternative embodiment of the plug-in connector 1'. The plug-in connector 1' comprises an essentially cuboid insulating body 2 which is provided with integrated individual conductor receiving devices 10. Individual conductors 7 of a connected cable (not illustrated) may be placed in the conductor receiving devices 10. The conductor ends of the individual conductors 7 lie on a conductive rubber element 4 that is oriented in a perpendicular manner thereto. The conductive rubber element 4 is inserted into a recess of the insulating body 2 and faces outward on the rear face of the insulating body 2 of the plug-in connector 1' and forms the so-called plug-in face. The conductive rubber element 4 may be connected on this face by way of example to conductor tracks of a circuit board (not illustrated). In order to fasten the plug-in connector 1' (circuit board plug-in connector), fastening eyelets are provided integrated into the side.

A locking element 13' is attached in a pivotable manner to the insulating body 2. The locking element 13' also assumes in this case the function of a flap for reversibly closing the plug-in connector 1'. The locking element 13' comprises approximately in the middle an inwardly-directed wedge-shaped element 16. As the locking element 13' is folded down, the wedge-shaped element 16 acts on the conductor end of the conductor 7 and—comparable to the schematic sketch in FIG. 6—exerts a force that is directed in an almost perpendicular manner. As a consequence, the conductor 7 or the conductor end is brought into electrical contact with conductive layers (not illustrated) of the conductive rubber element 4. This electrical contact may be transmitted by way of example to the conductor tracks of a circuit board via the plug-in face. It is however also conceivable to provide a matching mating connector (not illustrated) for this purpose.

The above illustrated locking elements 13, 13' may also be configured in segments. This means that one locking element 13 may be provided for each conductor. The conductors may then be connected one after the other.

Figure 13:
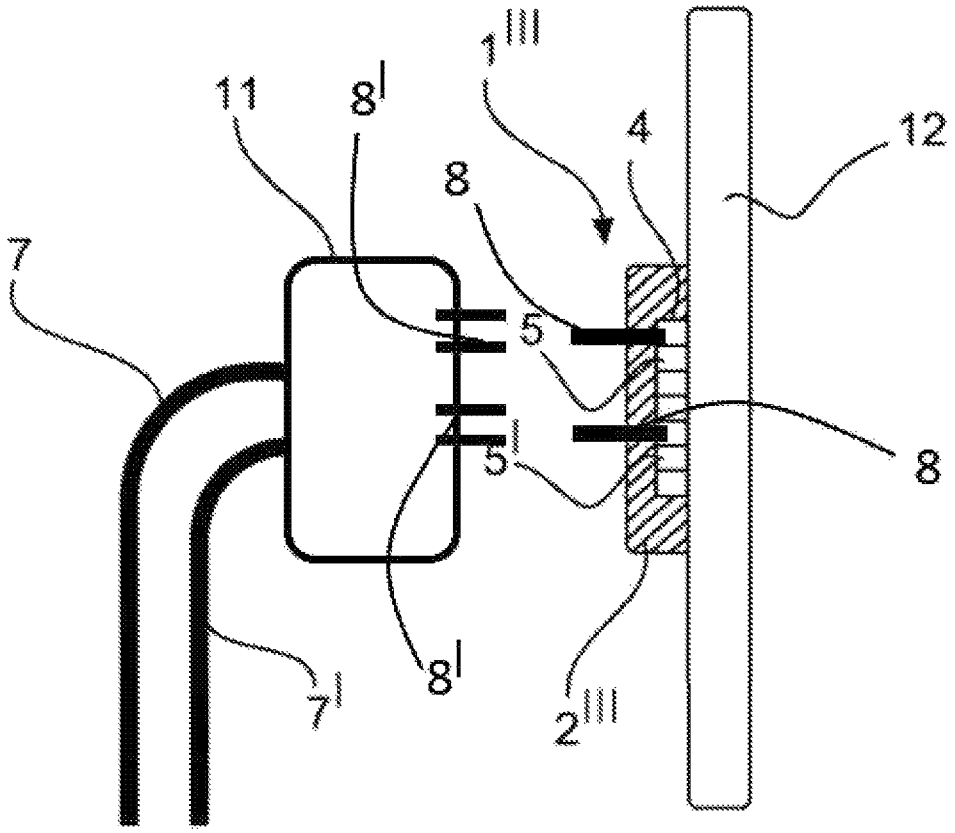
FIG. 13 illustrates a further schematic sketch of a system comprising a plug-in block and a circuit board plug-in connector.

FIG. 13 illustrates a plug-in block 11 in which conductors 7, 7', solid or stranded conductors as desired, are arranged and fixed with a direction vector orthogonal and/or parallel with the plug-in direction. A circuit board plug-in connector 1''' is illustrated lying opposite, a conductive rubber element 4 being arranged and fixed in the plug-in direction in the insulating body 2''' of said circuit board plug-in connector 1'''. The circuit board plug-in connector 1''' is arranged in this figure on a circuit board 12. On the rear face, the individual conductive layers 5, 5' of the conductive rubber element 4 are connected in an electrical manner to the conductor tracks (not illustrated) of the circuit board 12. The conductive rubber element is connected in this case to the contact elements 8 that protrude on the plug-in face out of the insulating body 2'''. The plug-in block 11 is likewise provided with contact elements 8' that likewise protrude in the plug-in direction and are connected in an electrical manner to the conductors 7, 7'. When the plug-in block 11 and the circuit board plug-in connector 1''' are plugged together, the contact elements 8' of the plug-in block 11 come into contact respectively with an allocated contact element 8 of the insulating body 2'''. As a consequence, the conductors 7, 7' are in electrical contact with the conductor tracks (not illustrated) of the circuit board 12.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A plug-in connector to which a cable having a plurality of insulated conductors is connectable in a linear array, wherein the plug-in connector comprises an insulating body and an elongated conductive rubber element arranged within the insulating body, the elongated conductive rubber element having a unitary structure distinct from the insulating body and comprising a plurality of conductive layers alternating with non-conductive layers and extending along a length of the elongated conductive rubber element to interface with conductor elements of the linear array of the plurality of insulated conductors or with intervening connection contacts associated with the conductor elements, and wherein a non-stripped end face of at least one of the plurality of insulated conductors is pressed against the elongated conductive rubber element.

2. The plug-in connector as claimed in claim 1, wherein each of the plurality of insulated conductors are fixable in an electrically conductive manner to at least one of the conductive layers of the elongated conductive rubber element.

3. The plug-in connector as claimed in claim 1, wherein the plug-in connector comprises at least one connection contact that is fixable in an electrically conductive manner to at least one of the conductive layers of the elongated conductive rubber element.

4. The plug-in connector as claimed in claim 3, wherein the at least one connection contact is configured to be contacted in an electrical manner by a conductor end of one of the plurality of insulated conductors.

5. The plug-in connector as claimed in claim 3, wherein the plug-in connector comprises at least one contact element.

6. The plug-in connector as claimed in claim 5, wherein:

one of the plurality of the insulated conductors is contactable by the at least one connection contact;

the at least one connection contact is in electrical contact on one face of the elongated conductive rubber element with at least one of the plurality of conductive layers; and on the other face of the elongated conductive rubber element, the at least one contact element is in contact with the at least one of the plurality of conductive layers of the elongated conductive rubber element.

7. The plug-in connector as claimed in claim 6, wherein the at least one connection contact is in electrical contact with the at least one contact element via the elongated conductive rubber element.

8. The plug-in connector as claimed in claim 2, wherein:

on one face of the elongated conductive rubber element at least one of the plurality of insulated conductors is fixable in an electrically conductive manner to at least one of the conductive layers of the elongated conductive rubber element; and on the other face of the elongated conductive rubber element, at least one contact element is contacted by the at least one of the conductive layers of the elongated conductive rubber element.

9. The plug-in connector as claimed in claim 8, wherein the conductor element of at least one of the plurality of insulated conductors is in electrical contact with the at least one contact element via the elongated conductive rubber element.

10. The plug-in connector as claimed in claim 1, wherein:

the plug-in connector comprises at least two connection contacts; and/or the plug-in connector comprises at least two contact elements.

11. The plug-in connector as claimed in claim 1, wherein each of the plurality of conductor layers of the elongated conductive rubber element comprise silver particles.

12. A system comprising a plug-in block and a circuit board plug-in connector, wherein at least two solid conductors or stranded conductors are fixed within the plug-in block parallel with one another and with a respective conductor end aligned with a direction vector parallel and/or orthogonal to a plug-in direction; and wherein the plug-in block comprises an insulating body and an elongated conductive rubber element arranged within the insulating body, the elongated conductive rubber element having a unitary structure distinct from the insulating body and comprising a plurality of conductive layers alternating with non-conductive layers and extending along a length of the elongated conductive rubber element, wherein the conductor ends of the at least two solid conductors or stranded conductors are in contact respectively with at least one conductive layer of the plurality of conductive layers of the elongated conductive rubber element, and wherein a respective non-stripped end face of the at least two solid conductors or stranded conductors is pressed against the elongated conductive rubber element.

13. The system as claimed in claim 12, wherein the circuit board plug-in connector comprises at least two contact elements having respectively one contact end and one circuit board connection end, wherein the respective contact ends are in contact with at least one conductive layer of the plurality of conductive layers of the elongated conductive rubber element.

* * * * *